US007040355B2

(12) United States Patent
Wu

(10) Patent No.: US 7,040,355 B2
(45) Date of Patent: May 9, 2006

(54) AIR NOZZLE AND RELIEF VALVE ARRANGEMENT FOR VERTICAL TIRE PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 296 days.

(21) Appl. No.: 10/736,034

(22) Filed: Dec. 15, 2003

(65) Prior Publication Data

US 2005/0129544 A1 Jun. 16, 2005

(51) Int. Cl.
*B65B 1/04* (2006.01)

(52) U.S. Cl. ..... 141/38; 152/415; 137/223

(58) Field of Classification Search ..... 141/38; 152/415; 137/223, 224, 228, 230
See application file for complete search history.

(56) References Cited

U.S. PATENT DOCUMENTS 5,307,846 A * 5/1994 Heinemann ..... 141/1
5,853,021 A * 12/1998 Grimes ..... 137/230
6,276,405 B1 * 8/2001 Wang ..... 141/38
6,786,247 B1 * 9/2004 Kemppainen et al. ..... 141/84
6,814,552 B1 * 11/2004 Wu ..... 417/440

* cited by examiner

*Primary Examiner*—Steven O. Douglas
(74) *Attorney, Agent, or Firm*—Alan D. Kamrath; Nikolai & Mersereau, P.A.

(57) ABSTRACT

An air nozzle and relief valve arrangement for use in a vertical tire pump is disclosed to include a lever-operated air nozzle adapted to guide pumped air into the inflatable body (tire), and a button-controlled relief valve installed in the lever-operated air nozzle and protected below the lever of the lever-operated air nozzle against outside dust for discharging excessive air pressure from the inflatable body (tire) when necessary.

18 Claims, 7 Drawing Sheets

AIR NOZZLE AND RELIEF VALVE ARRANGEMENT FOR VERTICAL TIRE PUMP

BACKGROUND OF THE INVENTION

1. Field of the Invention

The present invention relates to a vertical tire pump and, more specifically, to an air nozzle and relief valve arrangement for use in a vertical tire pump.

2. Description of the Related Art

FIG. 7 shows a conventional vertical tire pump, which was invented by the present inventor. This structure of vertical tire pump 1 has an inner tube 4 mounted inside the plunger tube 6 and connected to the handle 8, and a relief valve 7 mounted in the top end of the inner tube 4 inside the handle 8. Through the relief valve 7 the user can discharge excessive air pressure out of the inflatable body. If the user does not have a pressure gage, or does not know the standard pressure of the inflatable body, the user may press the inflatable body 10 with the fingers to check the internal pressure status of the inflatable body. If the internal pressure of the inflatable body is excessively high, the user can then open the relief valve 7 to discharge excessive air pressure out of the inflatable body. However, because the relief valve 7 is disposed in the handle 8 of the vertical tire pump 1 far away from the inflatable body, the user must move the hand through a long distance from the inflatable body to the relief valve 7 at the handle 8, and then open the relief valve 7 to discharge air. Due to a long distance between the inflatable body and the relief valve, a delay error may occur when discharging excessive air pressure out of the inflatable body, resulting in an accurate discharge. Further, if the relief valve failed, the user can not replace the relief valve by one self, and must ask a professional person to do the job or replace the whole vertical tire pump. The repair cost according to this design is high. Further, because this design is not a DIY (Do-It-Yourself) design, the user cannot install or dismount the relief valve by one self.

Therefore, it is desirable to provide an air nozzle and relief valve arrangement that eliminates the aforesaid drawbacks.

SUMMARY OF THE INVENTION

The present invention has been accomplished under the circumstances in view. It is the main object of the present invention to provide an air nozzle and relief valve arrangement, which enables the user to operate the relief valve to discharge excessive air pressure from the inflatable body efficiently and accurately with less effort. It is another object of the present invention to provide an air nozzle and relief valve arrangement, which enables the user to replace the relief valve by oneself when the relief valve failed, saving the repair cost. To achieve these and other objects of the present invention, the air nozzle and relief valve arrangement comprises an air nozzle, and a relief valve installed in the air valve. The air nozzle has a first end, a second end connected the air output hose of a vertical tire pump, an air passage extended between the first end and the second end, a filling plug assembly mounted in the first end, and a lever coupled to the filling plug assembly for operation by the user to move the filling plug assembly between an open position for enabling air to pass from the air passage to the inflatable body being connected to the first end and a close position to block said air passage. The relief valve is mounted in the air nozzle in air communication with the air passage, and selectively controlled to discharge air out of the air passage into the atmosphere. Because the relief valve is installed in the air nozzle, the user can conveniently efficiently operate the relief Valve with the same hand after checking the pressure status of the inflatable body. Further, the simple structure design enables the user to remove the relief valve from the air nozzle conveniently by one self for a replacement when the relief valve failed.

Other objects, advantages and features of the present invention will now be described by way of example with the annexed drawings.

DETAILED DESCRIPTION OF THE INVENTION

Figure 1:
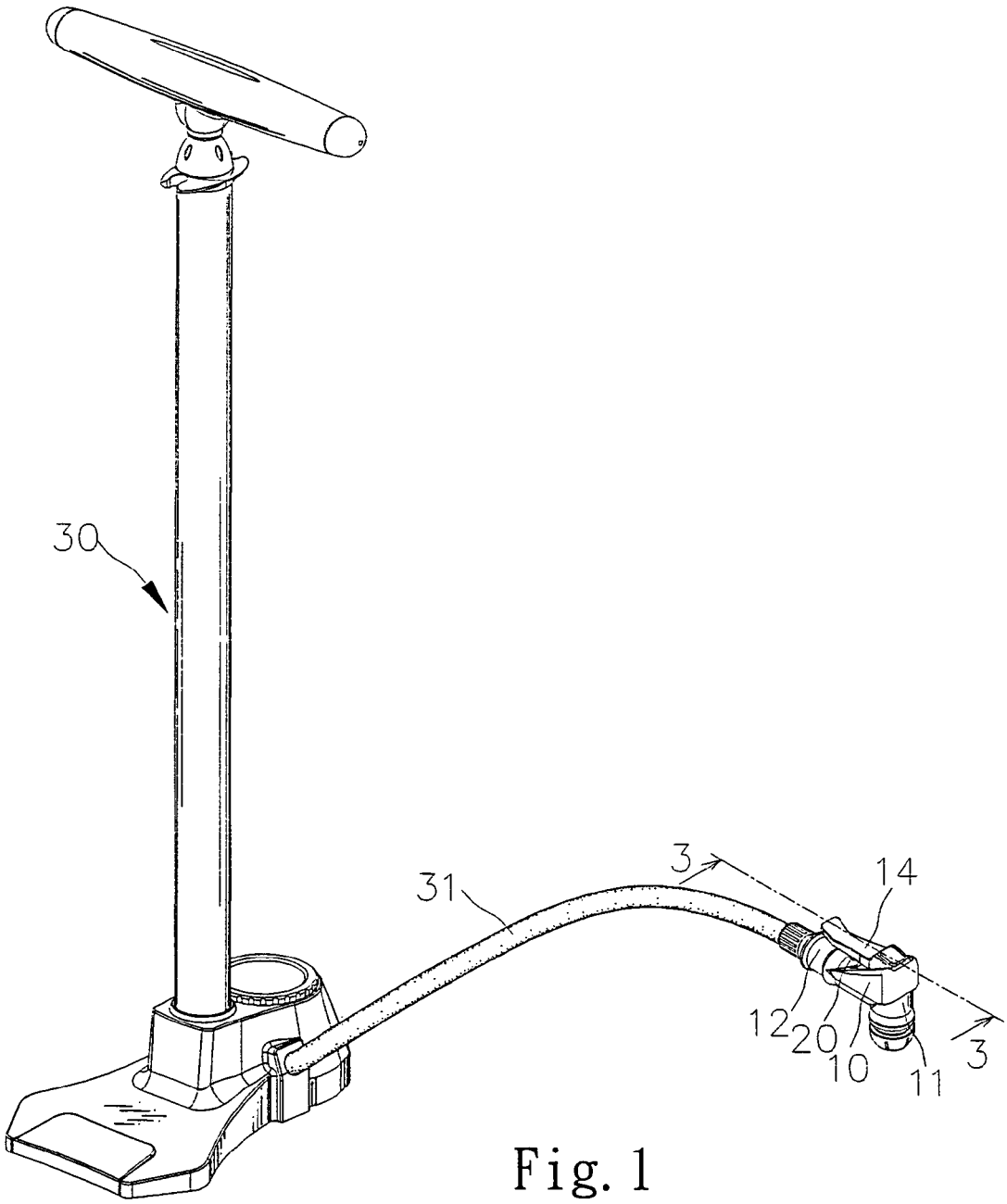
FIG. 1 is a perspective view showing an air nozzle and relief valve arrangement installed in a vertical tire pump according to the present invention.

Referring to FIG. 1, an air nozzle 10 is mounted with a relief valve 20, and connected to the hose 31 of a vertical tire pump 30.

Figure 2:
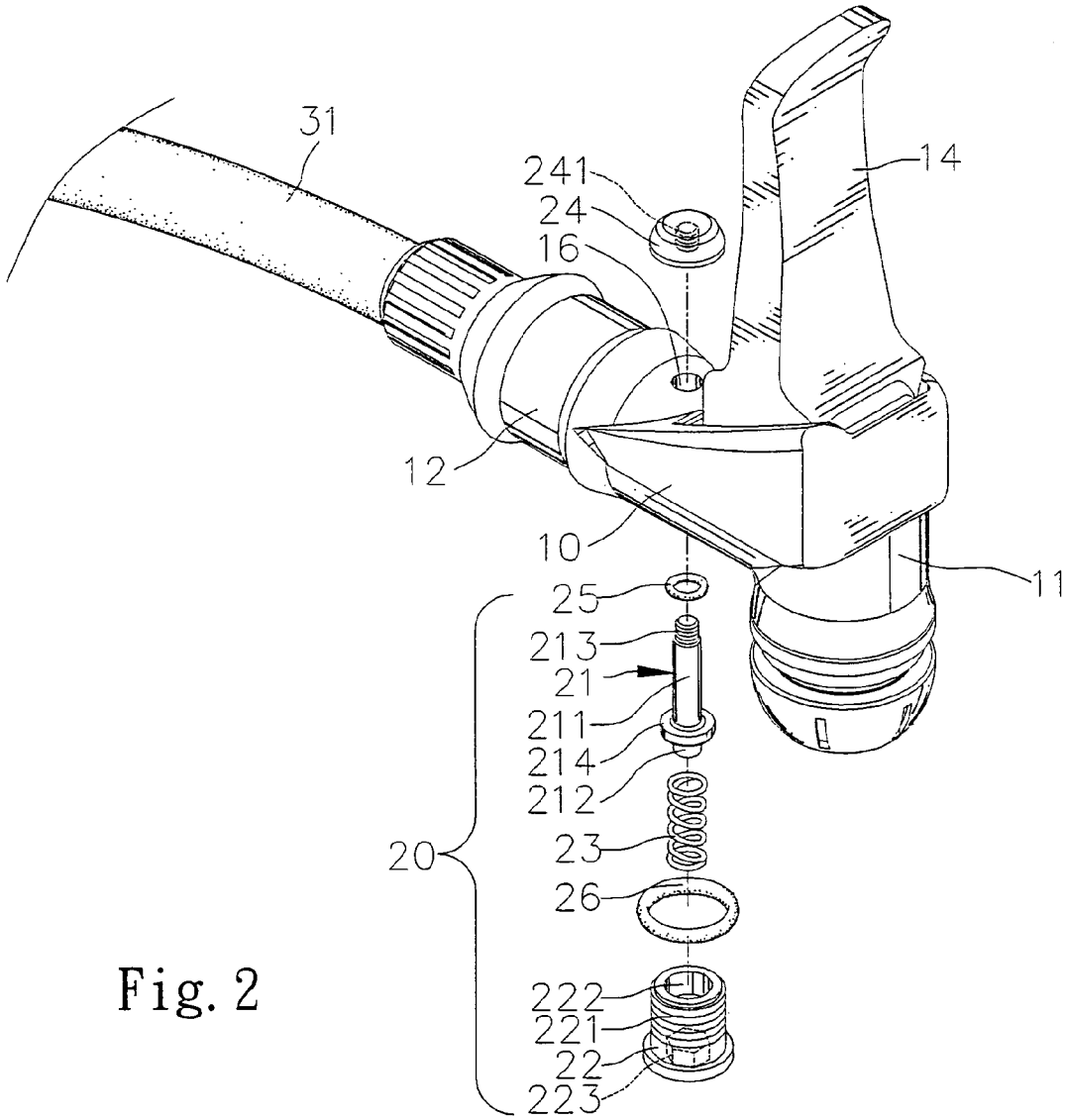
FIG. 2 is an exploded view of the preferred embodiment of the present invention.
Figure 3:
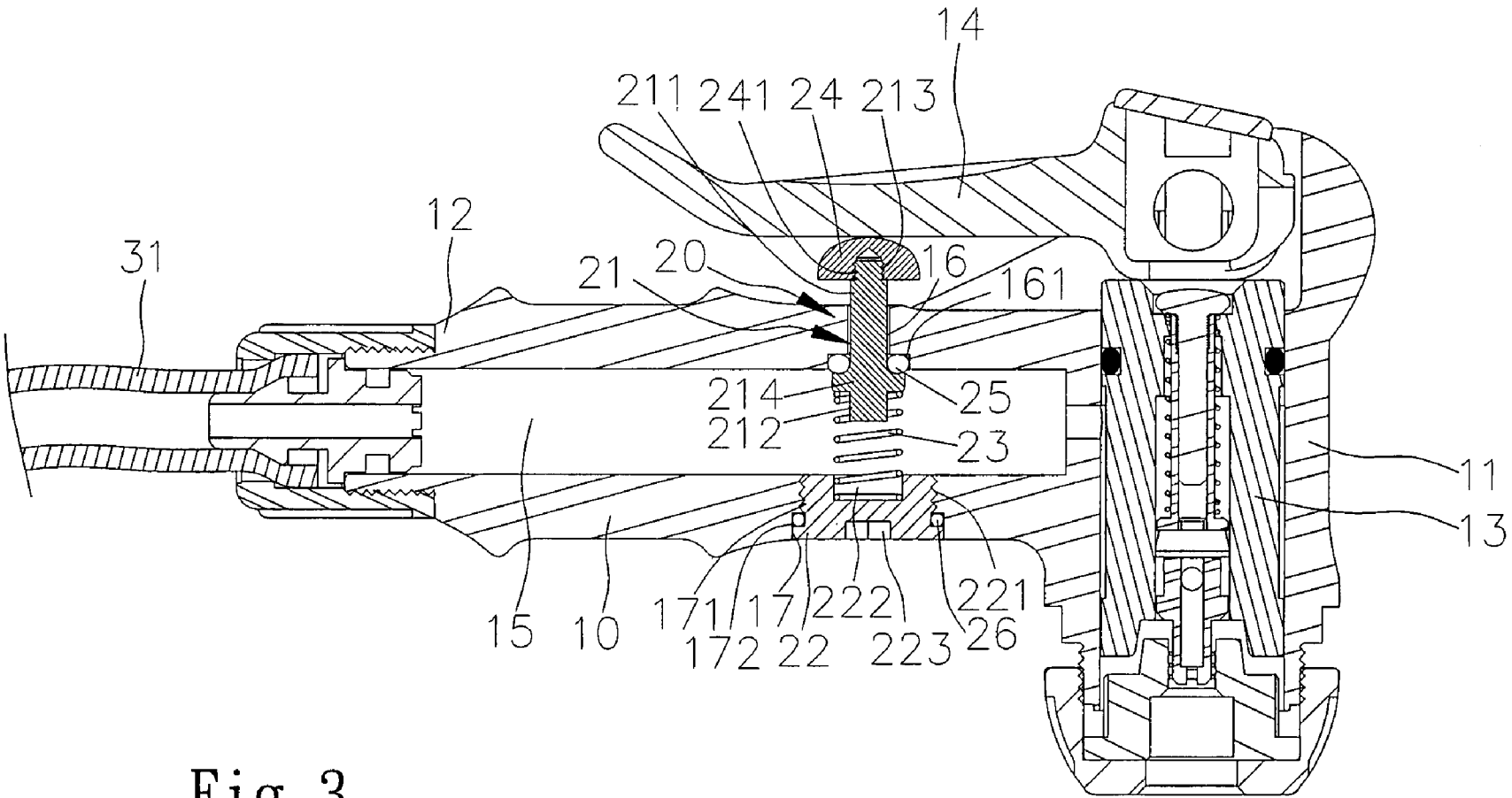
FIG. 3 is a sectional view taken along line 3—3 of FIG. 1.

Referring to FIGS. 2 and 3, the air nozzle 10 has a first end 11, a second end 12, an air passage 15 extended from the first end 11 to the second end 12, a filling plug assembly 13 mounted in the first end 11 and connectable to a US model air valve or French model air valve, and a lever 14 coupled to the first end 11 and adapted to control the filling plug assembly 13 and to further close/open the air passage 15. Because the filling plug assembly 13 is of the known art, no further detailed description in this regard is necessary. The second end 12 is coupled to the hose 31 of the vertical tire pump 30 for enabling pumped air to pass from the vertical tire pump 30 through the hose 31 into the internal air passage 15 of the air nozzle 10. The air nozzle 10 further has a first through hole 16 and a second through hole 17 respectively vertically disposed in communication with the air passage 15.

The relief valve 20 comprises a valve rod 21, a valve cap 22, and a spring member 23 provided between the stem washer 22 and the valve rod 21. The valve rod 21 has a first end 211 and a second end 212. The first end 211 is inserted through the first through hole 16 to the outside of the air nozzle 10. The outer diameter of the valve rod 21 is slightly smaller than the first through hole 16, leaving a gap. The first end 211 of the valve rod 21 has an outer thread 213 around the tip, which is threaded into the inner thread 241 of a button 24 that is disposed outside the air nozzle 10 for pressing by the user. The second end 212 of the valve rod 21 has a flange 214 extended around the periphery. An O-ring 25 is mounted on the first end 211 of the valve rod 21, and stopped between the flange 214 and the shoulder 161 of the first through hole 16. The valve cap 22 has an outer thread 221 threaded into an inner thread 171 inside the second through hole 17. An O-ring 26 is mounted on the valve cap 22, and stopped between the valve cap 22 and the shoulder 171 of the second through hole 17. The valve cap 22 has a center recessed hole 222 adapted to accommodate one end of the spring member 23. The other end of the spring member 23 is sleeved onto the second end 212 of the valve rod 21 and stopped against the flange 214. The valve cap 22 further has a bottom tool hole 223 adapted to receive a tool that is used to rotate the valve cap 22.

Referring to FIG. 3 again, normally, the relief valve 20 is closed, and the air passage 15 of the air nozzle 10 is not in communication with the atmosphere. As illustrated, the relief valve 20 is provided below the lever 14, which protects the relief valve 20 against outside dust.

Figure 4:
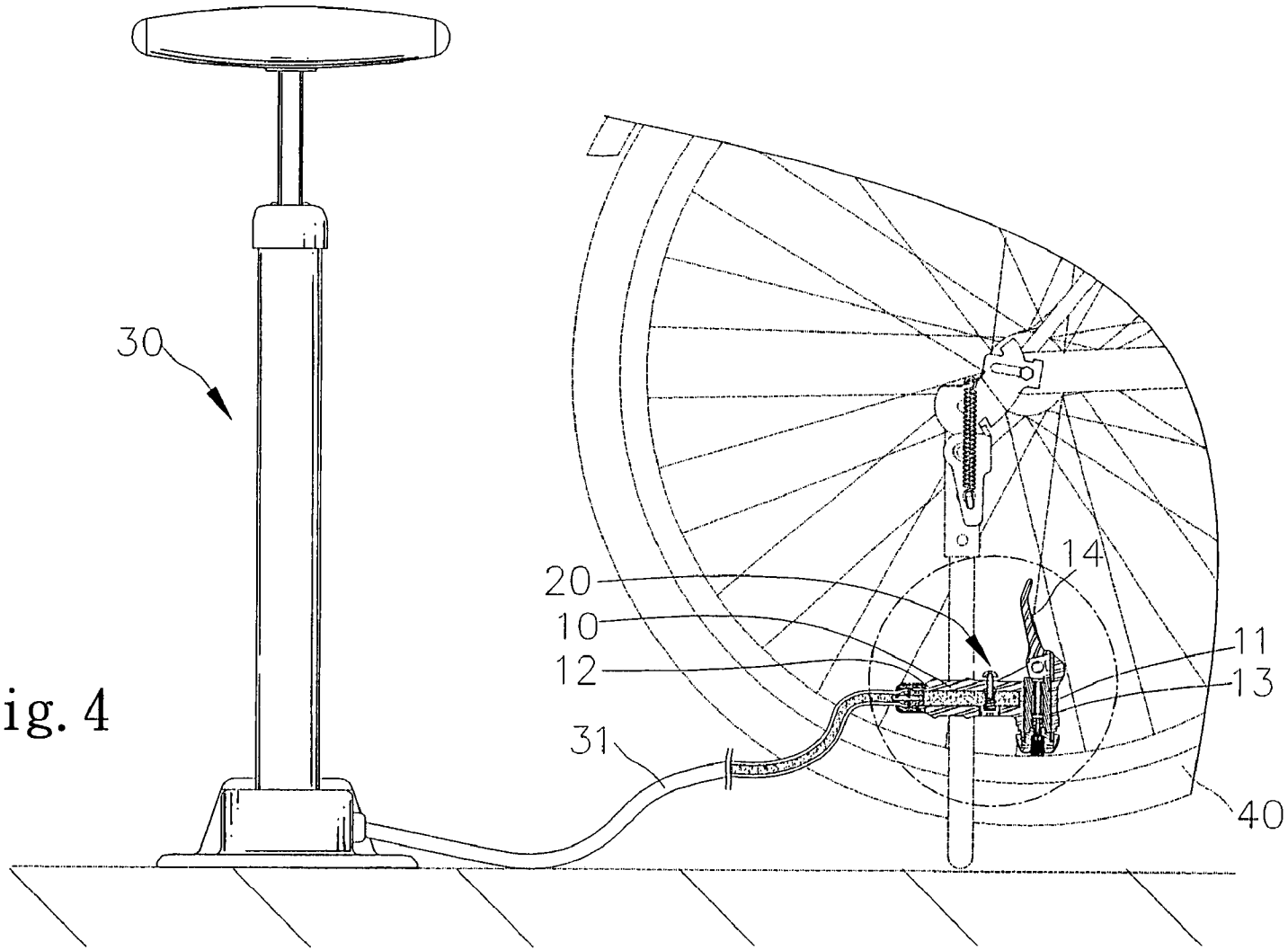
FIG. 4 is a sectional view showing an operation status of the present invention.
Figure 5:
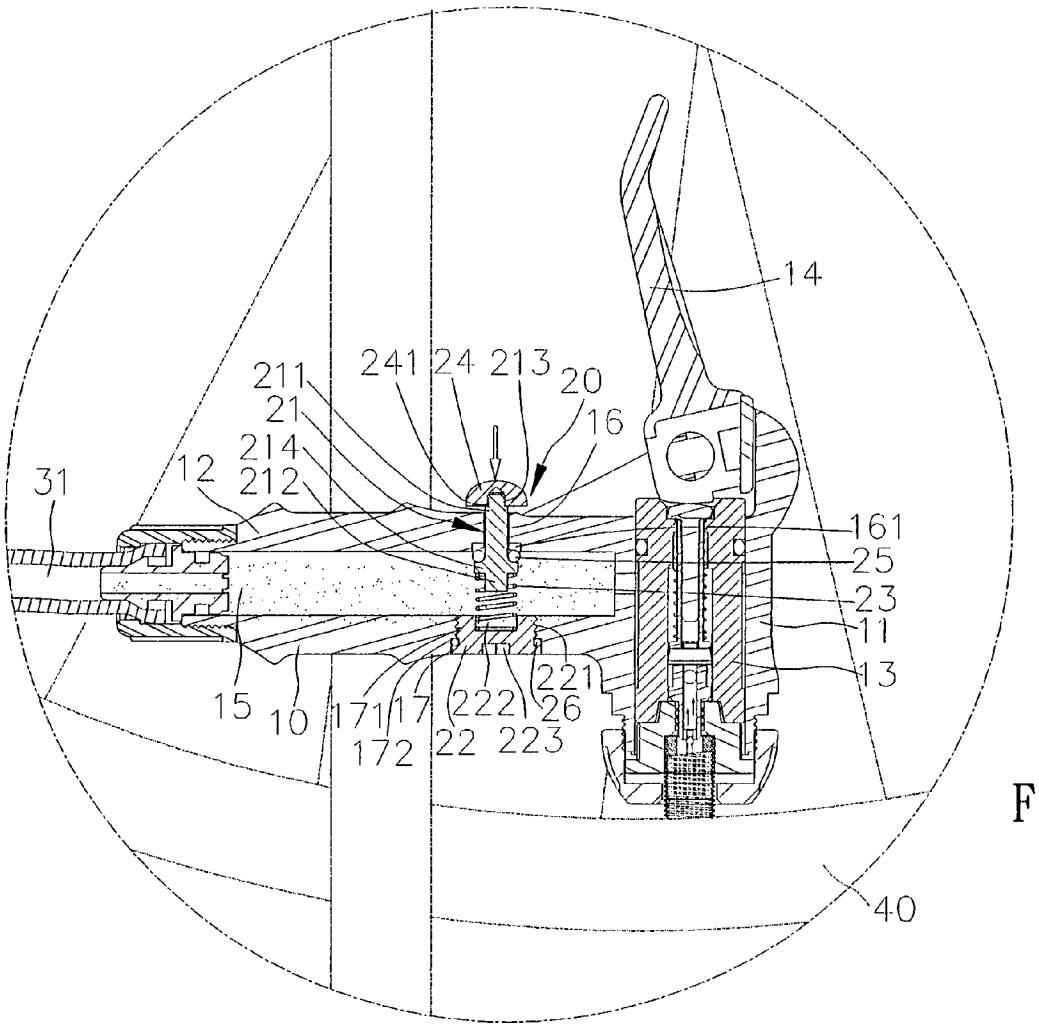
FIG. 5 is an enlarged view of a part of FIG. 4, showing the closed status of the relief valve.

Referring to FIGS. 4 and 5, before pumping operation, the lever 14 is lifted to open the filling plug assembly 13 to let the air passage 15 be in air communication with the inside space of the inflatable body (tire) 40 to be inflated. At this time, the air pressure of the air passage 15 is equal to the inside pressure of the inflatable body (tire) 40. If the tire pump is not equipped with a pressure gage, the user may press the inflatable body (tire) 40 with the fingers to check the internal pressure status of the inflatable body (tire) 40 during pumping operation.

Figure 6:
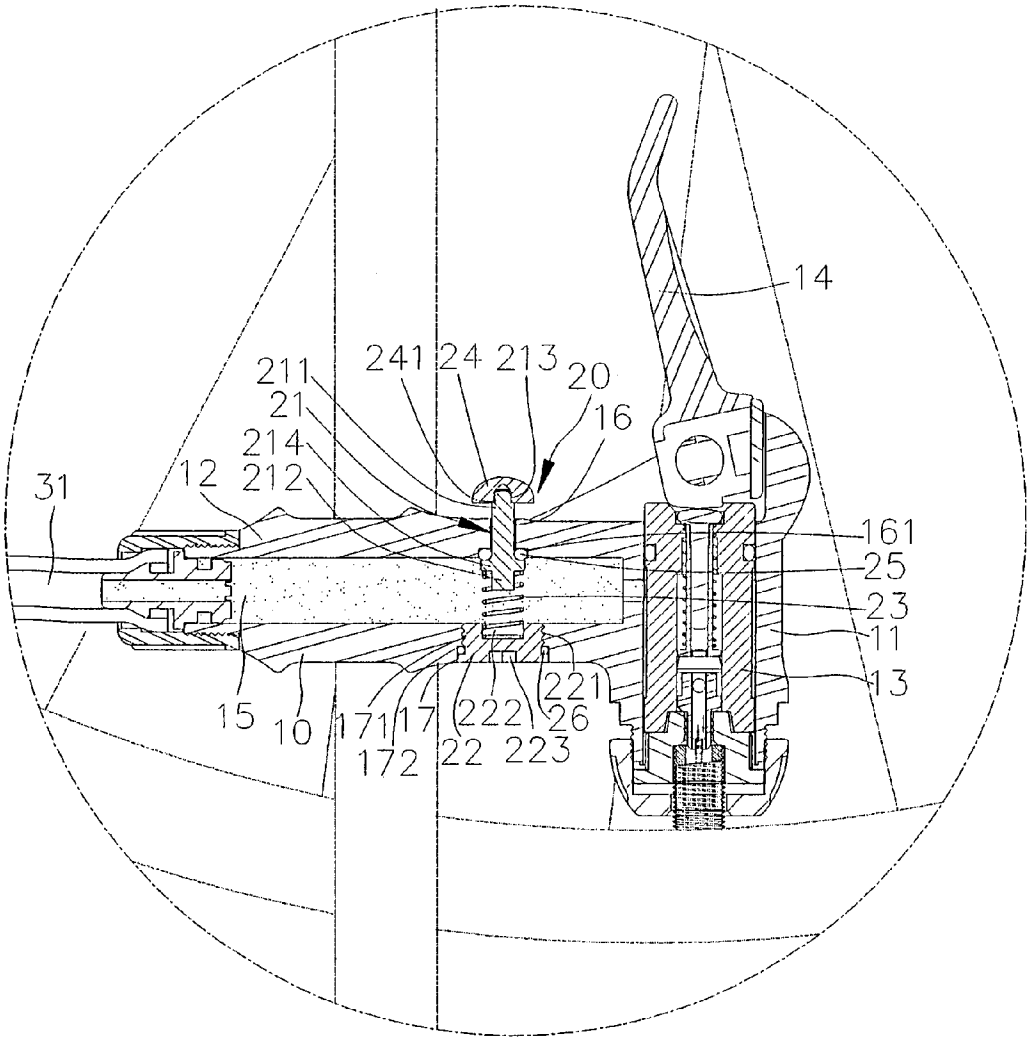
FIG. 6 is similar to FIG. 5 but showing the relief valve opened.
Figure 7:
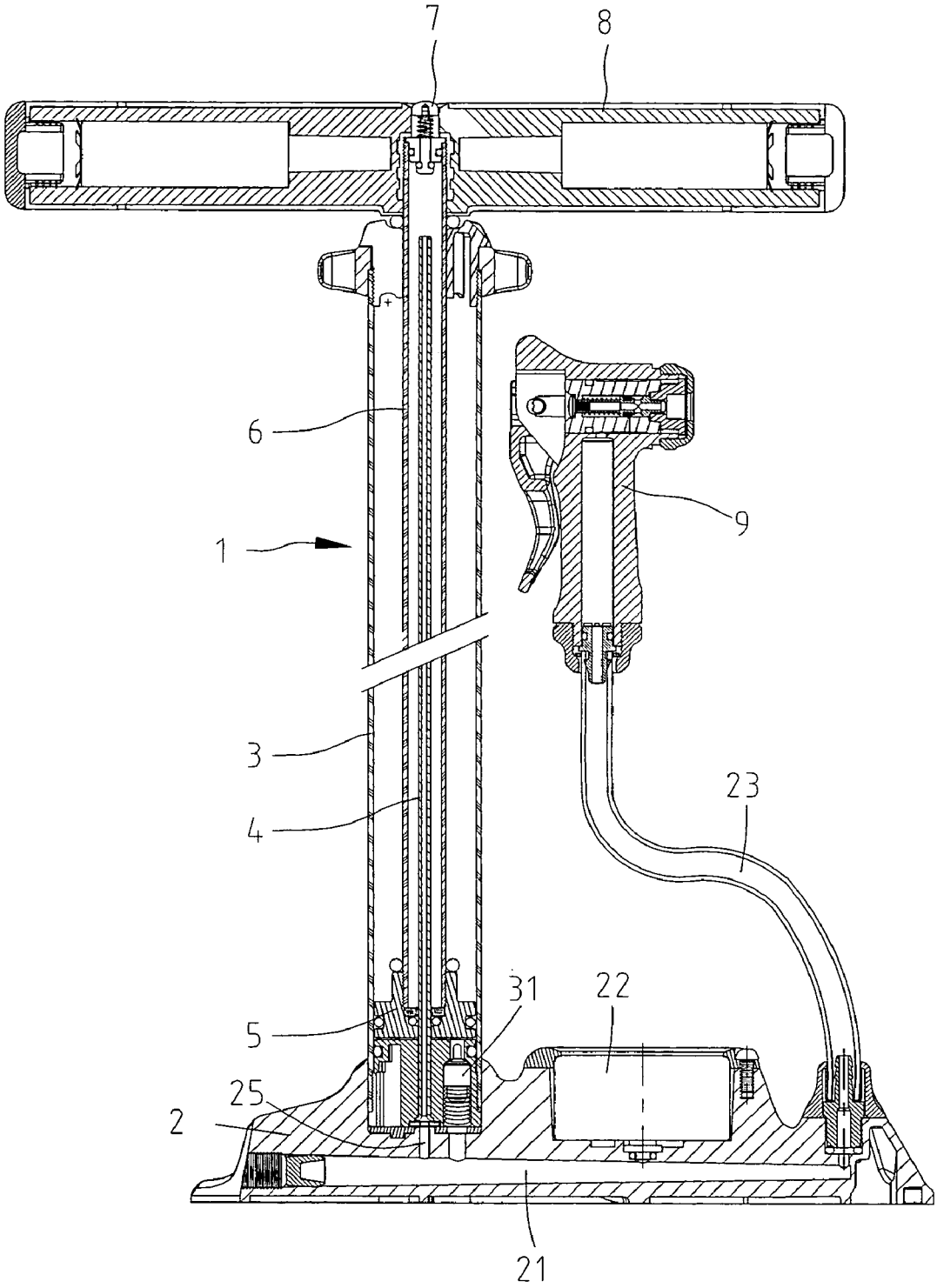
Fig. 7 PRIOR ART
FIG. 7 is a sectional view of a vertical tire pump according to the prior art.

Referring to FIG. 6, if the user feels that the air pressure of the inflatable body (tire) 40 is too high (a hard touch is sensed) after pressed the inflatable body (tire) 40 with the fingers, the user can then use the same hand to press the button 24, causing the relief valve 20 to discharge air. Because the relief valve 20 is installed in the air nozzle 10, which is connected to the inflatable body (tire) 40, the user can conveniently rapidly check the pressure status of the inflatable body (tire) 40 with the fingers and the press the button 24 to open the relief valve 20 with the same hand when necessary. When the user pressed the button 24 with the hand, the valve rod 21 is lowered to move the respective O-ring 25 away from the shoulder 161 of the first through hole 16, for enabling air to rapidly pass out of the inflatable body 40 to the atmosphere to lower the internal air pressure of the inflatable body (tire) 40.

More important, because the relief valve 20 is installed in the air nozzle 10, the short distance between the relief valve 20 and the inflatable body (tire) 40 enables air to be quickly and accurately discharged out of the inflatable body (tire) 40. When the relief valve 20 failed, the user can directly remove the air nozzle 10 from the tire pump 30 for a replacement without throwing the whole tire pump 30 away. This DIY (Do-It-Yourself) design enables the user to make the replacement by oneself without the help of a professional person, thereby reducing the repair cost.

A prototype of air nozzle and relief valve arrangement for vertical tire pump has been constructed with the features of FIGS. 1~6. The air nozzle and relief valve arrangement for vertical tire pump functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An air nozzle and relief valve arrangement used in a vertical tire pump, comprising:

an air nozzle, said air nozzle having a first end, a second end connected an air output hose of said vertical tire pump, an air passage extended between said first end and said second end, a filling plug assembly mounted in said first end, and a lever coupled to said filling plug assembly for operation by the user to move said filling plug assembly between an open position for enabling air to pass from said air passage to the inflatable body being connected to said first end and a close position to block said air passage; and a relief valve mounted in said air nozzle in air communication with said air passage and selectively controlled to discharge air out of said air passage into the atmosphere.

2. The air nozzle and relief valve arrangement as claimed in claim 1, wherein said filling plug assembly is selectively connectable to a US model air valve and a French model air valve.

3. The air nozzle and relief valve arrangement as claimed in claim 1, wherein said air nozzle has a first through hole and a second through hole respectively perpendicularly extended from said air passage and adapted to accommodate said relief valve.

4. The air nozzle and relief valve arrangement as claimed in claim 1, wherein said relief valve comprises a valve rod, a valve cap, a spring member provided between said valve rod and said valve cap, a first through hole formed in said air nozzle and adapted to accommodate said valve rod, and a second through hole formed in said air nozzle and adapted to accommodate said valve cap.

5. The air nozzle and relief valve arrangement as claimed in claim 4, wherein said valve rod has a first end inserted through said first through hole to the outside of said air nozzle, a second end suspended inside said air nozzle, and a flange extended around the periphery of said second end.

6. The air nozzle and relief valve arrangement as claimed in claim 5, wherein said relief valve further comprises an O-ring mounted on said valve rod and supported on said flange and adapted to be stopped between said flange and a shoulder in said first through hole.

7. The air nozzle and relief valve arrangement as claimed in claim 5, wherein said valve rod has an outer diameter smaller than said first through hole.

8. The air nozzle and relief valve arrangement as claimed in claim 5, wherein said relief valve further comprises a button fastened to the first end of said valve rod and disposed outside said air nozzle for operation by the user.

9. The air nozzle and relief valve arrangement as claimed in claim 4, wherein said valve cap has an outer thread, and said second through hole has an inner thread adapted to receive the outer thread of said valve cap.

10. The air nozzle and relief valve arrangement as claimed in claim 9, wherein said relief valve further comprises an O-ring mounted on said valve cap and stopped between said valve cap and a shoulder in said second through hole.

11. The air nozzle and relief valve arrangement as claimed in claim 9, wherein said valve cap has a center recessed hole adapted to hold one end of said spring member; said spring member has one end set in the center recessed hole of said valve cap and an opposite end sleeved onto the second end of said valve rod and stopped against said flange.

12. The air nozzle and relief valve arrangement as claimed in claim 9, wherein said valve cap has a bottom tool hole for the positioning of a tool adapted to rotate said valve cap.

13. The air nozzle and relief valve arrangement as claimed in claim 1, wherein said relief valve is in a close status when received no external pressure.

14. The air nozzle and relief valve arrangement as claimed in claim 1, wherein said relief valve is opened when pressed by the user.

15. The air nozzle and relief valve arrangement as claimed in claim 1, wherein said relief valve is disposed below said lever, and said lever protects said relief valve against outside dust.

16. The air nozzle and relief valve arrangement as claimed in claim 4, wherein said relief valve is in a close status when received no external pressure.

17. The air nozzle and relief valve arrangement as claimed in claim 4, wherein said relief valve is opened when pressed by the user.

18. The air nozzle and relief valve arrangement as claimed in claim 4, wherein said relief valve is disposed below said lever, and said lever protects said relief valve against outside dust.

* * * * *